US009824843B2

(12) United States Patent
Riedl

(10) Patent No.: US 9,824,843 B2
(45) Date of Patent: Nov. 21, 2017

(54) EMITTER WITH DEEP STRUCTURING ON FRONT AND REAR SURFACES

(71) Applicant: SIEMENS HEALTHCARE GMBH, Erlangen (DE)

(72) Inventor: Christian Riedl, Erlangen (DE)

(73) Assignee: Siemens Healthcare GmbH, Erlangen (DE)

( * ) Notice: Subject to any disclaimer, the term of this patent is extended or adjusted under 35 U.S.C. 154(b) by 6 days.

(21) Appl. No.: 15/186,717

(22) Filed: Jun. 20, 2016

(65) Prior Publication Data

US 2016/0372295 A1 Dec. 22, 2016

(30) Foreign Application Priority Data

Jun. 18, 2015 (DE) ..... 10 2015 211 235

(51) Int. Cl.

| | |
|---|---|
| ***H01J 35/06*** | (2006.01) |
| ***H01J 1/16*** | (2006.01) |
| ***H01J 21/10*** | (2006.01) |
| ***H01J 1/304*** | (2006.01) |
| ***H01J 3/02*** | (2006.01) |

(52) U.S. Cl.

CPC ..... *H01J 1/16* (2013.01); *H01J 1/3042* (2013.01); *H01J 3/022* (2013.01); *H01J 21/105* (2013.01); *H01J 35/06* (2013.01); *H01J 2201/30407* (2013.01)

(58) Field of Classification Search

CPC ..... H01J 1/16; H01J 1/3042; H01J 21/105; H01J 3/022; H01J 2201/30407; H01J 229/458; H01J 25/00; H01J 35/00–35/32

See application file for complete search history.

(56) References Cited

U.S. PATENT DOCUMENTS

| | | | | |
|---|---|---|---|---|
| 2,919,373 | A * | 12/1959 | Riley | H01J 1/22 313/340 |
| 4,344,011 | A * | 8/1982 | Hayashi | H01J 35/06 313/453 |
| 4,524,297 | A | 6/1985 | Gaertner | |
| 8,227,970 | B2 | 7/2012 | Freudenberger | |
| 8,385,506 | B2 * | 2/2013 | Lemaitre | H01J 1/20 378/136 |
| 8,547,005 | B1 | 10/2013 | Smith et al. | |
| 2008/0203885 | A1 | 8/2008 | Ono et al. | |
| 2010/0181942 | A1 | 7/2010 | Freudenberger | |
| 2010/0207508 | A1 * | 8/2010 | Terletska | H01J 1/13 313/341 |

(Continued)

FOREIGN PATENT DOCUMENTS

| | | | |
|---|---|---|---|
| DE | 3205746 | A1 | 8/1983 |
| DE | 2727907 | C2 | 11/1987 |

(Continued)

*Primary Examiner* — Joseph L Williams
*Assistant Examiner* — Jose M Diaz
(74) *Attorney, Agent, or Firm* — Laurence Greenberg; Werner Stemer; Ralph Locher

(57) ABSTRACT

An emitter has a basic unit with at least one emission surface. Accordingly, the basic unit has deep structuring in a region of the at least one emission surface. More specifically, the basic unit has the deep structuring on both a front side and on a rear side in the region of the emission surface for improving emission properties.

9 Claims, 4 Drawing Sheets

(56) References Cited

U.S. PATENT DOCUMENTS

| | | | | |
|---|---|---|---|---|
| 2014/0010354 | A1* | 1/2014 | Lemaitre | H01J 35/06 378/136 |
| 2015/0187536 | A1* | 7/2015 | Canfield | H01J 35/06 378/137 |
| 2016/0093462 | A1* | 3/2016 | Virshup | H01J 35/06 378/136 |

FOREIGN PATENT DOCUMENTS

| | | | |
|---|---|---|---|
| DE | 19914739 | C1 | 8/2000 |
| DE | 19955845 | A1 | 5/2001 |
| DE | 102009005454 | B4 | 2/2011 |
| DE | 102014211688 | A1 | 12/2015 |

* cited by examiner

| | S1 | S2 | S3 | S4 |
|---|---|---|---|---|
| Z1 | 0 μm | -25 μm | 0 μm | -25 μm |
| Z2 | -25 μm | -50 μm | -25 μm | -50 μm |
| Z3 | 0 μm | -25 μm | 0 μm | -25 μm |
| Z4 | -25 μm | -50 μm | -25 μm | -50 μm |
| Z5 | 0 μm | -25 μm | 0 μm | -25 μm |
| Z6 | -25 μm | -50 μm | -25 μm | -50 μm |
| Z7 | 0 μm | -25 μm | 0 μm | -25 μm |
| Z8 | -25 μm | -50 μm | -25 μm | -50 μm |
| Z9 | 0 μm | -25 μm | 0 μm | -25 μm |
| Z10 | -25 μm | -50 μm | -25 μm | -50 μm |
| Z11 | 0 μm | -25 μm | 0 μm | -25 μm |
| Z12 | -25 μm | -50 μm | -25 μm | -50 μm |

FIG 3

| | S1 | S2 | S3 | S4 |
|---|---|---|---|---|
| Z1 | -50 μm | -25 μm | -50 μm | -25 μm |
| Z2 | -25 μm | 0 μm | -25 μm | 0 μm |
| Z3 | -50 μm | -25 μm | -50 μm | -25 μm |
| Z4 | -25 μm | 0 μm | -25 μm | 0 μm |
| Z5 | -50 μm | -25 μm | -50 μm | -25 μm |
| Z6 | -25 μm | 0 μm | -25 μm | 0 μm |
| Z7 | -50 μm | -25 μm | -50 μm | -25 μm |
| Z8 | -25 μm | 0 μm | -25 μm | 0 μm |
| Z9 | -50 μm | -25 μm | -50 μm | -25 μm |
| Z10 | -25 μm | 0 μm | -25 μm | 0 μm |
| Z11 | -50 μm | -25 μm | -50 μm | -25 μm |
| Z12 | -25 μm | 0 μm | -25 μm | 0 μm |

8

72

FIG 4

| | S1 | S2 | S3 | S4 |
|---|---|---|---|---|
| Z1 | -50 μm | -50 μm | -50 μm | -50 μm |
| Z2 | -50 μm | -50 μm | -50 μm | -50 μm |
| Z3 | -50 μm | -50 μm | -50 μm | -50 μm |
| Z4 | -50 μm | -50 μm | -50 μm | -50 μm |
| Z5 | -50 μm | -50 μm | -50 μm | -50 μm |
| Z6 | -50 μm | -50 μm | -50 μm | -50 μm |
| Z7 | -50 μm | -50 μm | -50 μm | -50 μm |
| Z8 | -50 μm | -50 μm | -50 μm | -50 μm |
| Z9 | -50 μm | -50 μm | -50 μm | -50 μm |
| Z10 | -50 μm | -50 μm | -50 μm | -50 μm |
| Z11 | -50 μm | -50 μm | -50 μm | -50 μm |
| Z12 | -50 μm | -50 μm | -50 μm | -50 μm |

8

EMITTER WITH DEEP STRUCTURING ON FRONT AND REAR SURFACES

CROSS-REFERENCE TO RELATED APPLICATION

This application claims the priority, under 35 U.S.C. §119, of German application DE 10 2015 211 235.7, filed Jun. 18, 2015; the prior application is herewith incorporated by reference in its entirety.

BACKGROUND OF THE INVENTION

Field of the Invention

The invention relates to an emitter.

The lifetime of a thermal electron emitter in an X-ray tube (surface emitter, filament emitter) is in the first instance determined by the thermally induced evaporation of the emitter material used, generally tungsten. Hence, higher lifetimes can be achieved by either a higher material thickness of the emitter and/or a lower emitter temperature. In such cases, an increased thickness causes a linear increase in the lifetime, while the influence of the temperature on the evaporation of the material has an exponential dependence.

A reduction of the emitter temperature requires an enlargement of the emission surface and hence the emitter surface. Hence, greater effort is generally required to focus the electrons emitted to form an electron beam.

Increasing the material thickness in the region of the emission surface (thicker surface emitter plate, larger filament wire diameter) requires higher heating currents and results in higher thermal inertia. In the case of surface emitters with connecting legs (non-directly welded surface emitters), it is only possible to bend the connectors up to a specific emitter thickness. Hence, limits are placed on an increase in the material thickness.

German patent DE 27 27 907 C2 describes a surface emitter containing a basic unit with a rectangular emitter surface. The basic unit or the emitter surface has a layer thickness of from about 0.05 mm to about 0.2 mm and is, for example, made of tungsten, tantalum or rhenium. In the case of tungsten, it is also known to carry out potassium doping. The surface emitters produced in a rolling process have incisions which are arranged in alternation from two opposite sides transverse to the longitudinal direction. During the operation of the X-ray tubes, heating voltage is applied to the surface emitter of the cathode, wherein heating currents from about 5 A to about 20 A flow and electrons are emitted and accelerated in the direction of an anode. X-radiation is generated in the surface of the anode when the electrons strike the anode.

According to German patent DE 27 27 907 C2, the shape, length and arrangement of the lateral incisions enable special configurations of the temperature distribution to be achieved in the surface emitter since the heating of a body heated by current passage therethrough depends on the distribution of the electrical resistance across the current paths. Hence, less heat is generated at points at which the electrically active planar cross section of the surface emitter is greater than at points with a smaller cross section (points with a greater electrical resistance).

The surface emitter disclosed in German patent DE 199 14 739 C1 in turn contains a basic unit made of rolled tungsten plate and in this case has a circular emitter surface. The emitter surface is divided into conducting tracks extending in spirals that are spaced apart from one another by serpentine incisions.

In addition, published, non-prosecuted German patent application DE 10 2014 211 688.0 describes a surface emitter containing a monolithic basic unit. Selectively increasing the thickness of the basic unit at temperature-critical points causes local drops in the temperature at these points.

German patent DE 10 2009 005 454 B4, corresponding to U.S. Pat. No. 8,227,970, discloses an indirectly heated surface emitter. The surface emitter contains a primary emitter and a heating emitter spaced apart therefrom both having a circular primary surface. The primary emitter contains an unstructured primary emission surface, i.e. a homogeneous emission surface without slots. The directly heated heating emitter contains a structured heat emission surface, i.e. an emission surface with slots or serpentine tracks. The primary emission surface and the heat emission surface are aligned substantially parallel to one another and insulated from one another.

A cathode with a filament emitter (incandescent filament) is, for example, known from published, non-prosecuted German patent application DE 199 55 845 A1.

SUMMARY OF THE INVENTION

It is the object of the present invention to provide a compact emitter with improved emission properties.

The object is achieved according to the invention by an emitter as claimed in the main patent claim. Advantageous embodiments of the emitter according to the invention are the subject matter of each of the further claims.

The emitter contains a basic unit with at least one emission surface. According to the invention, the basic unit has deep structuring in the region of at least one emission surface.

As a result of the deep structuring provided according to the invention (three-dimensional structuring) of the basic unit in the region of at least one emission surface, in addition to the known emission surface extending in a horizontal direction, at least one further emission surface is formed, which extends in a vertical direction or at another predefinable angle to the horizontal emission surface.

While retaining the same electron emission, the solution according to the invention achieves a reduction in the temperature and hence an increase in the lifetime, which is effected without any enlargement of the horizontal emitter surface. Hence, there are no negative influences on the focusing of the electron beam due to lateral (horizontal) enlargement of the emission surface. Furthermore, conversion to the surface emitter according to the invention does not require any structural changes in the focusing head.

The emitter can, for example, be made of tungsten, tantalum, rhenium or appropriate alloys, wherein the material for the emitter can be appropriately doped (for example, potassium).

The emitter according to the invention can be embodied as a directly heated surface emitter with at least one rectangular emission surface or with at least one circular emission surface or as an indirectly heated surface emitter with a primary emission surface and a heat emission surface. The deep structuring according to the invention can also advantageously be realized with an emitter embodied as a filament emitter.

Deep structuring exclusively on the front side, which can be sufficient for certain applications, results in locally different emitter thicknesses in the region of the emission surface and hence to correspondingly different temperatures in the region of the emission surface. According to a particularly advantageous and preferred embodiment of the emitter according to the invention, therefore, in the region of the emission surface, the basic unit has deep structuring on both the front side and on the rear side. Here, the deep structuring on the front side of the basic unit serves to increase the electron emission at the same temperature or to reduce the temperature with the same electron emission. On the other hand, in the case of emitters that are supplied directly with current (resistance heating), the deep structuring on the rear side of the basic unit results in a reduction in the temperature differences in the region of the emission surface. Hence, both measures result in an extension of the lifetime of the emitter.

In this case, it is particularly advantageous for the basic unit to have a constant thickness in the region of the deep structuring. Here, the contours of the deep structuring on the rear side are arranged offset with respect to the contours of the deep structuring on the front side. The change in thickness resulting from the two types of deep structuring is hence constant over the entire emission surface so that the thickness of the basic unit in the region of the deep structuring does not change and hence no local differences occur in the temperature of the emission surface.

For the purposes of the invention, the deep structuring does not mandatorily have to have a predefinable contour; instead statically distributed structuring with respect to arrangement and shape is also possible.

If, however, the basic unit in the region of the deep structuring has a constant thickness, deep structuring with a predefinable three-dimensional contour is absolutely necessary. Deep structuring of this kind by means of a predefinable three-dimensional contour is preferably embodied as a cuboid contour, for example as cube-shaped contour. In the case of deep structuring with a cuboid contour, in addition to the emission surface extending in a horizontal direction, four emission surfaces extending in a vertical direction are obtained in each case.

As an alternative to a cuboid contour, the three-dimensional contour of the deep structuring can also have a pyramidal shape. In this case, the further emission surfaces are arranged at a predefinable angle other than 90° to the emission surface extending in a horizontal direction.

Other features which are considered as characteristic for the invention are set forth in the appended claims.

Although the invention is illustrated and described herein as embodied in an emitter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 is a rear side view of the basic unit in the region of the emission surface;

FIG. 4 is a view of an overall change in thickness of the basic unit in the region of the emission surface.

DETAILED DESCRIPTION OF THE INVENTION

Figures 1, 2:
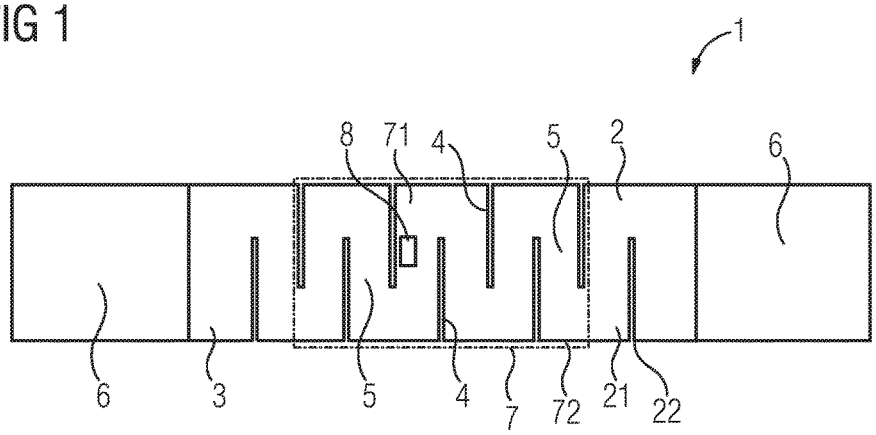
FIG. 1 is a diagrammatic, a top view in a region of a basic unit of an embodiment of an emitter according to the invention.
FIG. 2 is a front side view of the basic unit in the region of an emission surface.

Referring now to the figures of the drawings in detail and first, particularly to FIG. 1 thereof, there is shown an emitter 1 embodied as a surface. The surface emitter 1 has a rectangular basic unit 2 with an emitter surface 3, which is also rectangular. In a region of the emitter surface 3, the basic unit 2 contains a plurality of, in the exemplary embodiment depicted nine, incisions 4 which are arranged in alternation from two opposite sides transverse to the longitudinal direction. Therefore, the incisions 4 form a total of eight bars 5 on the emitter surface 3.

Furthermore, in the exemplary embodiment depicted, the basic unit 2 contains a mounting surface 6 on each of two end faces of the emitter surface 3. On the two mounting surfaces 6, the surface emitter 1 can be mounted in a focusing head (not shown).

There is at least one emission surface 7 on the emitter surface 3. In the exemplary embodiment depicted, the surface emitter contains exactly one emission surface 7, which extends over virtually the entire emitter surface 3.

In the embodiment shown, the basic unit 2 has deep structuring 71 or 72 on both a front side 21 and on a rear side 22 in the region of the emission surface 7.

Here, the deep structuring 71 on the front side 21 of the basic unit 2 serves to increase the electron emission at the same temperature or to reduce the temperature with the same electron emission. In the case of emitters that are directly supplied with current (resistance heating), the deep structuring 72 on the rear side 22 of the basic unit 2 results in a reduction in the temperature difference in the region of the emission surface 7.

The types of deep structuring 71 and 72 are explained in the following in FIGS. 2 to 5 with reference to a section of the emission surface 7 designated 8 in FIG. 1.

The types of deep structuring 71 and 72 can for example be produced by subtractive methods (for example, laser structuring) and/or additive methods (screen printing, 3D-printing). A combination of different subtractive methods or different additive methods or the combination of at least one subtractive method with at least one additive method can also be used to generate types of deep structuring.

In the exemplary embodiment depicted in FIGS. 2 to 5, the deep structuring 71 on the front side 21 of the basic unit 2 and the deep structuring 72 on the rear side 22 of the basic unit 2 are each applied in the region of the emission surface 7 by means of laser structuring (erosion of the material by means of laser beams).

The types of laser structuring are produced parallel and equidistant to the longitudinal sides and the end faces of the emitter surface 3 or the emission surface 7 so that contours with a rectangular cross section are formed. The types of deep structuring 71 and 72 (material erosion) created by means of laser beams are provided at right angles to the front side 21 or rear side 22 of the basic unit 2 thus resulting in three-dimensional contours in the form of cuboids.

The structuring method is explained with the usual model used for matrices in mathematics, wherein, in FIGS. 2 to 4, the contours extending in a horizontal direction are arranged in lines Z1 to Z12 and the contours extending in a vertical direction are arranged in columns S1 to S4.

As explained in the exemplary embodiment depicted with reference to FIG. 2, the deep structuring 71 on the front side 21 of the basic unit 2 is created by laser structuring in lines Z2, Z4, Z6, Z8, Z10 and Z12 and then in columns S2 and S4. Here, the erosion width is 50 μm in each case and the erosion depth 25 μm in each case.

According to FIG. 3, the deep structuring 72 on the rear side 22 of the basic unit 2 is created by laser structuring in columns S1 and S3 with an erosion width of 50 μm in each case and an erosion depth of 50 μm in each case. Furthermore, laser structuring is created in columns S2 and S4 with an erosion width of 50 μm in each case and an erosion depth of 25 μm in each case.

Hence, the material erosion causes the deep structuring 71 (FIG. 2) to form in the region of the emission surface 7 on the front side 21 of the basic unit 2 and the deep structuring 72 (FIG. 3) to form on the rear side 22 of the basic unit 3.

Due to the identical erosion width for the horizontal material erosion in lines Z1 to Z12 and for the vertical material erosion in columns S1 to S4, contours with a square cross section are formed, in the exemplary embodiment shown in FIGS. 2 to 5, in each case a square with a side length of 50 μm.

As is evident from a comparison of the types of deep structuring 71 and 72 (FIGS. 2 and 3), they are arranged such that the reduced thickness of the basic unit 2 shown in FIG. 4 due to both types of deep structuring 71 and 72 is constant in the region of the emission surface 7; in the embodiment shown, it is 50 μm. Since the thickness of the basic unit 2 is constant in the region of the emission surface 7 despite the types of deep structuring 71 and 72, the resistance determining the temperature of the emission surface 7 is also constant so that there are no local disparities in the emitter temperature.

Figure 5:
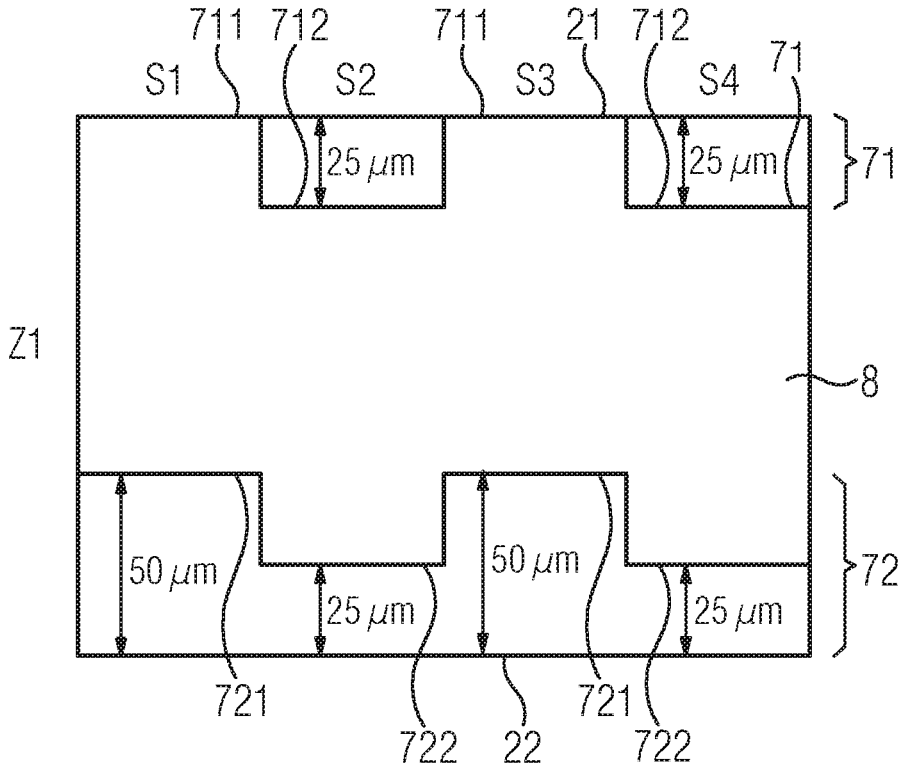
FIG. 5 is a side view of the basic unit in a marginal region of the emission surface.

It is evident from the side view of the section 8 of the emission surface 7 shown in FIG. 5 in the region of line Z1 that the basic unit 2 has a constant thickness in the region of the emission surface 7. This is achieved due to the fact that the deep structuring 71 on the front side 21 of the basic unit 2 and the deep structuring 72 on the rear side 22 of the basic unit 2 are matched to one another. The deep structuring 71 has the contours 711 and 712 while the deep structuring 72 has the contours 721 and 722.

All the contours 711 and 712 and 721 and 722 have a square primary surface with a side length of 50 pm in each case, wherein the erosion depths of the contours are different. The contours 711 (Z1/S1 and Z1/S3) have an erosion depth of 0 μm (no erosion) in each case and the erosion depth of the opposite contours 721 (Z1/S1 and Z1/S3) is in each case 50 μm (more erosion). The erosion depth of the opposite contours 712 (Z1/S2 and Z1/S4) and 722 (Z1/S2 and Z1/S4) is in each case 25 μm. Overall, the erosion depths of the opposite contours 711 and 721 or 721 and 722 are 50 μm in each case so that the thickness of the basic unit 2 is constant in the region of the emission surface 7.

In the embodiment shown in FIGS. 2 to 5, an average vertical emission surface of 4×0.5×(25 μm×50 μm) is formed for each square contour (50 μm×50 μm) on the front side 21 of the basic unit 2, wherein the factor 0.5 takes into account the fact that one edge is to be assigned to two adjacent contours. Hence, a doubling of the active emission surface is obtained for a completely structured emission surface 7.

According to the Richardson-Dushman law, the dependence of the electron emission on the temperature of an emitter, in the present case the surface emitter 1 with a thickness of 150 μm before the deep structuring and a thickness of 100 μm thickness after the deep structuring, results in a temperature reduction of approximately 80° C. in a typical emitter temperature range of 2,300° C. to 2,400° C., which is equivalent to an increase in the lifetime by a factor of three with respect to a 100 μm thick emitter and a factor of two with respect to a 150 μm thick emitter.

As is evident from the description of the exemplary example depicted in FIGS. 1 to 5, no undefined increase in the roughness of the front side 21 of the basic unit 2 of the surface emitter 1 should be created. Instead, vertical emission surfaces should be produced selectively. According to the result of electron beam simulations, the suggested 50 μm grid with a square contour of the deep structuring 71 with a reduction of the emission surface by 25 μm to 50 μm relative to the environment is suitable for preventing entry to the space-charge region, i.e. full electron emission is accessible.

The production of vertical emission surfaces increases the active emission surface without enlarging the lateral emission surface 7 relevant for focusing.

The increased surface or electron emission can be used to reduce the temperature of the emitter and hence to achieve a higher lifetime. If an increased lifetime is not required, it is possible—in each case without reducing the lifetime of the emitter—on the one hand, to achieve higher emission currents with the existing emitter design and, on the other, to use smaller focusing-relevant emitter dimensions with a changed emitter design, which is generally advantageous for the focusing quality of the electron beam and a possible requirement for it be possible to block the emitter.

Although the invention was illustrated and described in more detail by means of a preferred exemplary embodiment, the invention is not restricted by the exemplary embodiment of a surface emitter shown in FIGS. 1 to 5. Instead, other variants of the inventive solution may be derived herefrom without difficulty by the person skilled in the art without departing from the underlying inventive idea.

For example, the deep structuring according to the invention can be implemented not only with surface emitters with a rectangular emission surface, but, for example, also with surface emitters with a circular emitter surface. The solution according to the invention can also be implemented with indirectly heated surface emitters or filament emitters.

The invention claimed is:

1. An emitter, comprising:

a basic unit having at least one emission surface with a front side and a rear side, said emission surface having incisions formed therein running from two opposite sides of said front side and transverse to a longitudinal direction of the emitter, said basic unit having deep structuring formed therein in a region of said at least one emission surface on said front side and on said rear side between said incisions and separate from said incisions.

2. The emitter according to claim 1, wherein said at least one emission surface of said basic unit has at least one rectangular emission surface.

3. The emitter according to claim 1, wherein said at least one emission surface of said basic unit has at least one circular emission surface.

4. The emitter according to claim 1, wherein said at least one emission surface of said basic unit is embodied as a filament emitter.

5. The emitter according to claim 1, wherein said basic unit has a constant thickness in a region of said deep structuring.

6. The emitter according to claim 1, wherein said deep structuring has a predefinable three-dimensional contour.

7. The emitter according to claim 6, wherein said deep structuring has a cuboid contour.

8. The emitter according to claim 6, wherein said deep structuring has a pyramidal contour.

9. An emitter, comprising:

a basic unit having at least one emission surface, said basic unit having deep structuring formed therein in a region of said at least one emission surface, said basic unit having at least one first emission surface embodied as a primary emission surface and at least one second emission surface embodied as a heat emission surface, said first and second emission surfaces are aligned substantially parallel to one another and insulated from one another and at least one of said first and second emission surfaces having said deep structuring.

* * * * *